US007708876B2

(12) United States Patent
Bolshakov et al.

(10) Patent No.: US 7,708,876 B2
(45) Date of Patent: May 4, 2010

(54) HEAVY FUEL OIL

(75) Inventors: Valentin Filippovich Bolshakov, St. Petersburg (RU); Aleksandr Valentinovich Bolshakov, St. Petersburg (RU); Tamara Nikitovna Mitusova, Moscow (RU); Sergey Olegovich Shinkov, Moscow (RU); Tatiana Felikosovna Ovchinnikova, Yaroslav (RU)

(73) Assignee: Oiltreid Limited Liabilities Company, Moscow (RU)

( * ) Notice: Subject to any disclaimer, the term of this patent is extended or adjusted under 35 U.S.C. 154(b) by 204 days.

(21) Appl. No.: 11/816,096

(22) PCT Filed: Jul. 11, 2006

(86) PCT No.: PCT/RU2006/000364

§ 371 (c)(1), (2), (4) Date: Aug. 10, 2007

(87) PCT Pub. No.: WO2007/011261

PCT Pub. Date: Jan. 25, 2007

(65) Prior Publication Data

US 2008/0073247 A1 Mar. 27, 2008

(30) Foreign Application Priority Data

Jul. 18, 2005 (RU) ..... 2005122581

(51) Int. Cl.
*C10L 1/00* (2006.01)
*C10L 1/04* (2006.01)
*C10L 1/10* (2006.01)
*C10L 1/16* (2006.01)

(52) U.S. Cl. ..... 208/15; 585/1; 44/300

(58) Field of Classification Search ..... 585/1; 208/15; 44/300
See application file for complete search history.

(56) References Cited

U.S. PATENT DOCUMENTS

| | | | | |
|---|---|---|---|---|
| 2,048,371 | A * | 7/1936 | Calderwood | 208/15 |
| 2,104,919 | A | 1/1938 | Whitney | |
| 2,360,272 | A | 10/1944 | Plummer | |
| 2,678,262 | A | 5/1954 | Neely et al. | |
| 2,687,991 | A | 8/1954 | Miller | |
| 2,692,821 | A | 10/1954 | Ambrose et al. | |
| 2,697,033 | A | 12/1954 | Ambrose et al. | |
| 2,739,051 | A | 3/1956 | Rogers et al. | |
| 2,755,229 | A | 7/1956 | Beuther et al. | |
| 2,760,852 | A | 8/1956 | Stevens et al. | |
| 2,864,498 | A | 12/1958 | Matthews et al. | |
| 3,089,761 | A | 5/1963 | Andress et al. | |
| 3,234,118 | A | 2/1966 | Chen | |
| 3,567,639 | A | 3/1971 | Aaron et al. | |
| 3,660,058 | A | 5/1972 | Feldman et al. | |
| 3,767,564 | A | 10/1973 | Youngblood et al. | |
| 3,835,022 | A | 9/1974 | Frayer et al. | |
| 3,853,497 | A | 12/1974 | Miller et al. | |
| 4,156,434 | A | 5/1979 | Parker et al. | |
| 4,264,334 | A * | 4/1981 | Durand et al. | 44/384 |
| 4,299,594 | A | 11/1981 | Pelrine et al. | |
| 4,446,002 | A | 5/1984 | Siegmund | |
| 4,508,614 | A | 4/1985 | Yan | |
| 4,513,155 | A * | 4/1985 | Tamura et al. | 585/13 |
| 4,802,892 | A | 2/1989 | Shimada et al. | |
| 4,853,337 | A | 8/1989 | Dickakian | |
| 4,932,980 | A | 6/1990 | Mueller et al. | |
| 5,362,375 | A | 11/1994 | Kubo et al. | |
| 5,593,463 | A | 1/1997 | Gambini et al. | |
| 5,917,101 | A | 6/1999 | Munoz | |
| 6,056,793 | A | 5/2000 | Suppes | |
| 6,136,049 | A | 10/2000 | Nakajima et al. | |
| 6,215,034 | B1 | 4/2001 | Oomori et al. | |
| 6,265,629 | B1 | 7/2001 | Fava et al. | |
| 6,291,732 | B2 | 9/2001 | Hubbard et al. | |
| 6,534,453 | B2 | 3/2003 | Omori et al. | |
| 6,776,897 | B2 | 8/2004 | Bacha et al. | |
| 6,846,402 | B2 | 1/2005 | Hemighaus et al. | |
| 6,972,084 | B1 | 12/2005 | Nakashima et al. | |
| 7,033,484 | B2 | 4/2006 | Bacha et al. | |
| 2003/0136047 | A1 | 7/2003 | Ketley et al. | |
| 2005/0040072 | A1 | 2/2005 | Respini et al. | |
| 2005/0234273 | A1 * | 10/2005 | Chen | 585/1 |
| 2006/0122442 | A1 | 6/2006 | Kohler et al. | |

FOREIGN PATENT DOCUMENTS

| | | |
|---|---|---|
| EP | 0338311 A1 | 10/1989 |
| EP | 1230325 A1 | 8/2002 |

(Continued)

*Primary Examiner*—Glenn A Caldarola
*Assistant Examiner*—Pamela Weiss
(74) *Attorney, Agent, or Firm*—Panitch Schwarze Belisario & Nadel LLP

(57) ABSTRACT

This invention relates to oil refining, more particularly to a composition of a heavy fuel oil for use in marine power units and boiler plants. The fuel comprises, in percent by weight: an extract from the selective extraction of gas oil—(3-5), heavy catalytic cracking gas oil—(3-10), vacuum gas oil—(5-10), tar or topped residuum—(3-10), straight-run black oil—(10-20), viscosity breaking residue of heavy oil fractions—the rest. The selected combination of the components and their ratio may for example, result in a stable heavy fuel oil having improved viscosity properties. The inclusion of the above components into the fuel composition may also make it possible to expand the production of heavy fuel oils produced.

2 Claims, No Drawings

FOREIGN PATENT DOCUMENTS

| | | | | |
|---|---|---|---|---|
| EP | 1661966 | A1 | * | 5/2006 |
| GB | 187351 | A | | 10/1922 |
| GB | 578517 | A | * | 7/1946 |
| JP | 57016892 | A | | 1/1982 |
| JP | 63030594 | A | | 2/1988 |
| JP | 8259966 | A | | 10/1996 |
| JP | 8311462 | A | | 11/1996 |
| JP | 2001019977 | A | | 1/2001 |
| JP | 2001019978 | A | | 1/2001 |
| RU | 2009172 | C1 | | 3/1994 |
| RU | 2076138 | C1 | * | 3/1997 |
| RU | 2139912 | C1 | * | 10/1999 |
| RU | 2155211 | C1 | * | 8/2000 |
| RU | 2185415 | C1 | | 7/2002 |

* cited by examiner

HEAVY FUEL OIL

This application is a national phase application of International Application No. PCT/RU2006/000364, international filing date Jul. 11, 2006 which claims priority to Patent Application of Russian Federation No. 2005122581, filed Jul. 18, 2005. These documents are hereby incorporated by reference in their entirety.

BACKGROUND OF THE INVENTION

This invention relates to oil processing, more particularly to a composition of a fuel oil, such as heavy fuel oil that may be used in marine power units and boiler plants.

A heavy fuel oil is known which comprises a distillate of asphalt thermal cracking and a deasphalting residue in the ratio from 30:70 to 50:50 (SU 1575560, C 10 L 1/04, 1999).

However, this fuel may be unstable and does not possess required viscosity-temperature properties.

Another type of available fuel is a heavy fuel oil that comprises a viscosity breaking residue of heavy oil fractions and deasphalted heavy oil fractions in the ratio from 70:30 to 90:10. In some instances, this fuel may contain light oil fractions as described in JP 60-123554, C 08 L 91/00, 1985.

In Russia, however, deasphalted oil fractions are mainly used as raw stock in production of lubricants, and their availability is limited.

Another known heavy fuel oil is based on the viscosity breaking residue of a black oil and tar mixture having the boiling temperature range from 360° C.-KK and comprises 1-5% by wt. of an extract from the process of selective extraction of gas oil, up to 10% by wt. of heavy catalytic cracking gas oil, up to 2% by wt. of a residual component obtained from the process of deasphalting oils with propane, and 0.5-2.5% by wt. of slop wax (RU 2185415, C 10 L 1/04, 2002).

A disadvantage of the said technical solution is that the use of a residual component obtained in the process of oils deasphalting with propane in its composition leads to a significant increase in viscosity and a higher pour point of the fuel.

SUMMARY OF THE INVENTION

Two objectives of the present disclosure are to lower the viscosity and improve the stability of a heavy fuel oil.

Additional objects and advantages of the invention will be set forth in part in the description which follows. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE INVENTION

A fuel oil of the present disclosure comprises viscosity breaking residue of heavy oil fractions, an extract from the selective extraction of gas oil, heavy catalytic cracking gas oil, vacuum gas oil, tar or topped residuum and straight-run black oil in the following component ratio, in percent by wt.:

| | |
|---|---|
| Extract from the selective extraction of gas oil | 3-5 |
| Heavy catalytic cracking gas oil | 3-10 |
| Vacuum gas oil | 5-10 |
| Tar or topped residuum | 3-10 |
| Straight-run black oil | 10-20 |
| Viscosity breaking residue of heavy oil fractions | the rest. |

In another embodiment, the fuel oil of the present disclosure may comprise 0.02-0.10% by wt. of a pour-point depressant.

The fuel oil of the present disclosure is characterized by that the fuel composition comprises vacuum gas oil, tar or topped residuum and straight-run black oil in the claimed ratio.

The selected combination of the components and their ratio are able, for example, to achieve a stable fuel oil having improved viscosity properties. Further, the inclusion of the above components into the fuel composition may enable to expand the range of heavy fuel oils produced for marine and boiler plant applications.

In one embodiment, the fuel oil of the present disclosure may be prepared by mixing the components through agitation.

Three specimens of the fuel oil of the present disclosure were prepared according to the said method.

The characteristics of the components used for preparing the said fuel specimens are shown in Table 1.

A tar viscosity breaking residue was used in preparing specimens of the fuel oil of the present disclosure.

In one embodiment, an additive on the basis of copolymers of ethylene and vinyl acetate may be used as a pour-point depressant, for example those known in the field, such as, Paradin-70, ECA-7433. In preparing the fuel specimens the Paradin-70 additive was used.

The compositions of the inventive fuel specimens and their quality indices are shown in Table 2.

The data from Table 2 confirms that the specimens of the fuel oil of the present disclosure may comply with the Specifications for high-viscosity marine fuel oil (TU 3810113114) and with the national standard for boiler plant fuel oil (GOST 10585-75).

It is intended that the specification and examples be considered as exemplary only, with a true scope and spirit of the invention being indicated by the following claims.

TABLE 1

CHARACTERISTICS OF THE COMPONENTS USED FOR PREPARING SPECIMENS OF THE INVENTIVE HEAVY FUEL OIL

| Item | PARAMETERS | Viscosity breaking residue | Extract from selective treatment of oils | Heavy catalytic cracking gas oil | Vacuum gas oil | Tar | Topped residuum | Black oil |
|---|---|---|---|---|---|---|---|---|
| 1. | Pour point, ° C. | 34 | 30 | 22 | 21 | 19 | 18 | 26 |
| 2. | Conditional viscosity at: | | | | | | | |
| | 80° C. | 43.3 | 33.8 | 1.47 | 2.10 | — | 19.5 | 14.2 |
| | 100° C. | 16.5 | 12.6 | 1.31 | 1.66 | 70 | 8.2 | 6.05 |

TABLE 1-continued

CHARACTERISTICS OF THE COMPONENTS USED FOR PREPARING SPECIMENS OF THE INVENTIVE HEAVY FUEL OIL

| Item | PARAMETERS | Viscosity breaking residue | Extract from selective treatment of oils | Heavy catalytic cracking gas oil | Vacuum gas oil | Tar | Topped residuum | Black oil |
|---|---|---|---|---|---|---|---|---|
| 3. | Cinematic viscosity, $mm^2$/sec at: | | | | | | | |
| | 80° C., | 330 | 250 | 5.9 | 13.0 | — | 150 | 107 |
| | 100° C. | 124 | 88 | 4.02 | 7.6 | 530 | 60 | 45.6 |
| 4. | Mass fraction of sulfur, % | 2.8 | 1.9 | 1.6 | 1.8 | 3.0 | 2.5 | 2.6 |
| | Coking ability, % | | | | | | | |

TABLE 2

COMPOSITIONS OF THE SPECIMENS OF THE INVENTIVE HEAVY FUEL OIL AND THEIR QUALITY INDICES

| | | Component content, % by wt. | | |
|---|---|---|---|---|
| Item | COMPONENTS | Specimen 1 | Specimen 2 | Specimen 3 |
| 1. | Extract from the selective extraction of gas oil | 3 | 4 | 5 |
| 2. | Heavy catalytic cracking gas oil | 3 | 6 | 10 |
| 3. | Vacuum gas oil | 5 | 5 | 10 |
| 4. | Tar | 5 | — | 3 |
| 5. | Topped residuum | — | 10 | — |
| 6. | Black oil | 10 | 15 | 20 |
| 7. | Pour-point depressant | — | — | 0.10 |
| 8. | Viscosity breaking residue | The rest | The rest | The rest |
| | QUALITY INDICES | | VALUES | |
| 1. | Conditional viscosity at 100° C., CV degrees | 46.5 | 30.6 | 50.1 |
| 2. | Cinematic viscosity at 100° C., $mm^2$/sec | 330 | 230 | 360 |
| 3. | Pour point, ° C. | 30 | 26 | 15 |
| 4. | Mass fraction of sulfur, % | 2.69 | 2.58 | 2.30 |
| 5. | Stability: | | | |
| | spot | 2 | 1 | 1 |
| | total residue at chemical ageing, % | 0.02 | 0.01 | 0.005 |

The invention claimed is:

1. A heavy fuel oil consisting essentially of the following components, in percent by weight:

| | |
|---|---|
| Extract from the Selective extraction of gas oil | 3-5; |
| Heavy catalytic cracking gas oil | 3-10; |
| Vacuum gas oil | 5-10; |
| Tar or topped residuum | 3-10; |
| Straight-run black oil | 10-20; and |
| Viscosity breaking residue of Heavy oil fractions | the rest. |

2. A heavy fuel oil consisting essentially of the following components, in percent by weight:

| | |
|---|---|
| Extract from the selective extraction of gas oil | 3-5; |
| Heavy catalytic cracking gas oil | 3-10; |
| Vacuum gas oil | 5-10; |
| Tar or topped residuum | 3-10; |
| Straight-run black oil | 10-20; |
| Pour-point depressant | 0.02-0.10; and |
| Viscosity breaking residue of heavy oil fractions | the rest. |

* * * * *